US011066208B2

(12) United States Patent
Simpkins et al.

(10) Patent No.: US 11,066,208 B2
(45) **Date of Patent: *Jul. 20, 2021**

(54) SHIPPERS WITH A CONSTANT DEPTH

(71) Applicant: WestRock Shared Services, LLC, Atlanta, GA (US)

(72) Inventors: Kevin M. Simpkins, Cumming, GA (US); Jeffrey S. James, Elmhurst, IL (US); Chad Rebmann, Maple Valley, WA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/712,477

(22) Filed: Dec. 12, 2019

(65) Prior Publication Data

US 2020/0407103 A1 Dec. 31, 2020

Related U.S. Application Data

(63) Continuation-in-part of application No. 16/455,215, filed on Jun. 27, 2019, now Pat. No. 10,954,026.

(51) Int. Cl.
*B65D 5/54* (2006.01)
*B65D 5/02* (2006.01)

(52) U.S. Cl.
CPC ..... *B65D 5/5415* (2013.01); *B65D 5/0227* (2013.01)

(58) Field of Classification Search
CPC ..... B65D 5/328; B65D 5/0005; B65D 5/541; B65D 5/4279; B65D 5/445; B65D 5/5425; B65D 5/6632; B65D 2571/00666; B65D 5/323; B65D 5/66
USPC .... 229/122.3, 210, 211, 221, 237, 240, 242, 229/103, 122.23, 122.32, 122.34, 919; 206/774, 736, 557, 738, 746, 759
See application file for complete search history.

(56) References Cited

U.S. PATENT DOCUMENTS

| | | | | |
|---|---|---|---|---|
| 3,276,667 | A * | 10/1966 | Johnson | B65D 5/5445 206/557 |
| 7,690,554 | B2 * | 4/2010 | Zacher | B65D 5/541 229/109 |
| 8,342,335 | B2 * | 1/2013 | Couture | B65D 5/54 206/746 |
| 2007/0090175 | A1 * | 4/2007 | Schemmel | B65D 71/36 229/242 |
| 2012/0234724 | A1 * | 9/2012 | James | B65D 5/5445 206/774 |
| 2015/0041481 | A1 * | 2/2015 | Dean | B65D 5/323 220/826 |

* cited by examiner

*Primary Examiner* — Christopher R Demeree
(74) *Attorney, Agent, or Firm* — Neil G. Cohen; John B. Swingle

(57) ABSTRACT

A container includes a blank having a plurality of panels foldably connected to one another and erected about an interior space, and a plurality of top flaps foldably connected to the plurality of panels to enclose a top end of the interior space, and a plurality of bottom flaps wherein each of the bottom flaps is foldably connected to a corresponding panel of plurality of panels to enclose a bottom end of the interior space. The blank includes a line of weakness pattern configured to allow a user to break the top flaps from a closed configuration enclosing the interior space to an open configuration allowing access to the interior space.

12 Claims, 5 Drawing Sheets

SHIPPERS WITH A CONSTANT DEPTH

This application is a Continuation in Part of application Ser. No. 16/455,255 filed on Jun. 27, 2019, which is incorporated herein by reference in its entirety.

BACKGROUND

1. Field

The present disclosure relates to shipping containers, and more particularly to shipping containers with features to allow for custom sizing, opening or unboxing experience for the end user, and the like.

2. Description of Related Art

Products that up until recently were almost exclusively purchased in a physical retail setting are increasingly available to consumers through ecommerce venders that ship the products directly to the consumer. For shipping purposes there is a concomitant shift from shipping in bulk to shipping products on an individual basis. Traditionally, ecommerce products are packed in standard boxes with standard packing such as bubble wrap as needed.

The conventional techniques have been considered satisfactory for their intended purpose. However, there is an ever present need for improved packaging, e.g. for shipping ecommerce products and the like. This disclosure provides a solution for this need.

SUMMARY

A container includes a blank including a plurality of panels foldably connected to one another and erected about an interior space, and a plurality of top flaps foldably connected to the plurality of panels to enclose a top end of the interior space, and a plurality of bottom flaps wherein each of the bottom flaps is foldably connected to a corresponding panel of plurality of panels to enclose a bottom end of the interior space. The blank includes a line of weakness pattern configured to allow a user to break the top flaps from a closed configuration enclosing the interior space to an open configuration allowing access to the interior space.

The plurality of panels can include a front panel, a first side panel, a back panel opposed to the front panel, and a second side panel opposed to the first side panel.

The top flaps, the first side panel, and the second side panel can include perforations of the line of weakness pattern. The perforations in the top flaps can define a top opener feature configured for a user to initiate breaking the top flaps. The perforations in the first and second side panels can follow respective arcuate paths. Each of the front and back panels can include a respective hinge line defined therein for hinging the blank into the open configuration. Each hinge line can extend into each of the first and second side panels.

The top flaps can include a back top flap foldably connected to the back panel, a front top flap foldably connected to the front panel, a first side top flap foldably connected to the first side panel, and a second side top flap foldably connected to the second side panel. The top opener feature can be aligned with the edge notches of the first and second side top flaps. The perforations across each respective one of the first and second side top flaps can divide each of the first and second side top flaps into a front portion and a back portion, wherein the front portions are adhered to the front top flap, and wherein the back portions are adhered to the back top flap.

In another aspect, it is also contemplated that the top flaps and the front panel can include perforations of the line of weakness pattern. The perforation in the front panel can define an opening tab configured for a user to initiate breaking the line of weakness pattern. The top flaps can include a back top flap foldably connected to the back panel, a front top flap foldably connected to the front panel, a first side top flap foldably connected to the first side panel, and a second side top flap foldably connected to the second side panel, wherein the line of weakness pattern includes perforations in the front top flap, the first side top flap, and the second side top flap. The perforation in the first side top flap can divide the first side top flap into a breakaway portion adhered to the top back flap and a non-breakaway portion adhered to a non-breakaway portion of the front top flap. The perforation in the second side top flap can divide the second side top flap into a breakaway portion adhered to the top back flap and a non-breakaway portion adhered to a non-breakaway portion of the front top flap. A breakaway portion of the front top flap can be adhered to the breakaway portions of the first and second side top flaps.

A method includes packaging a plurality of product items into respective containers. For each container, packaging includes forming a blank around a mandrel to surround an interior space with a plurality of panels, adhering top flaps of the blank to enclose a top end of the interior space, cutting the plurality of panels to a custom length, placing product inside the interior space wherein the blank includes a line of weakness pattern configured to allow break the top flaps from a closed configuration enclosing the interior space to an open configuration allowing access to the interior space.

For each respective container, the method can include cutting the plurality of panels to a custom length before closing the bottom panels of the container, wherein the custom length varies from container to container.

Another method includes opening a container that includes a blank including a plurality of panels foldably connected to one another and erected about an interior space, and a plurality of top flaps foldably connected to the plurality of panels to enclose a top end of the interior space, wherein the blank includes a line of weakness pattern configured to allow break the top flaps from a closed configuration enclosing the interior space to an open configuration allowing access to the interior space. Opening includes breaking the line of weakness pattern and hinging the top flaps into the open configuration.

Breaking the line of weakness pattern can include breaking an opening tab in each of the first and second side panels, breaking an opening feature in the top flaps, gripping the opening feature to break the top flaps, and hinging the top flaps into the open configuration along hinge lines defined in the front and back panels. It is also contemplated that breaking the line of weakness pattern can include breaking an opening tab in the front panel, breaking perforations in the front top flap and the first and second side top flaps, and hinging the back flap into the open configuration along a fold line connecting the back flap to the back panel.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
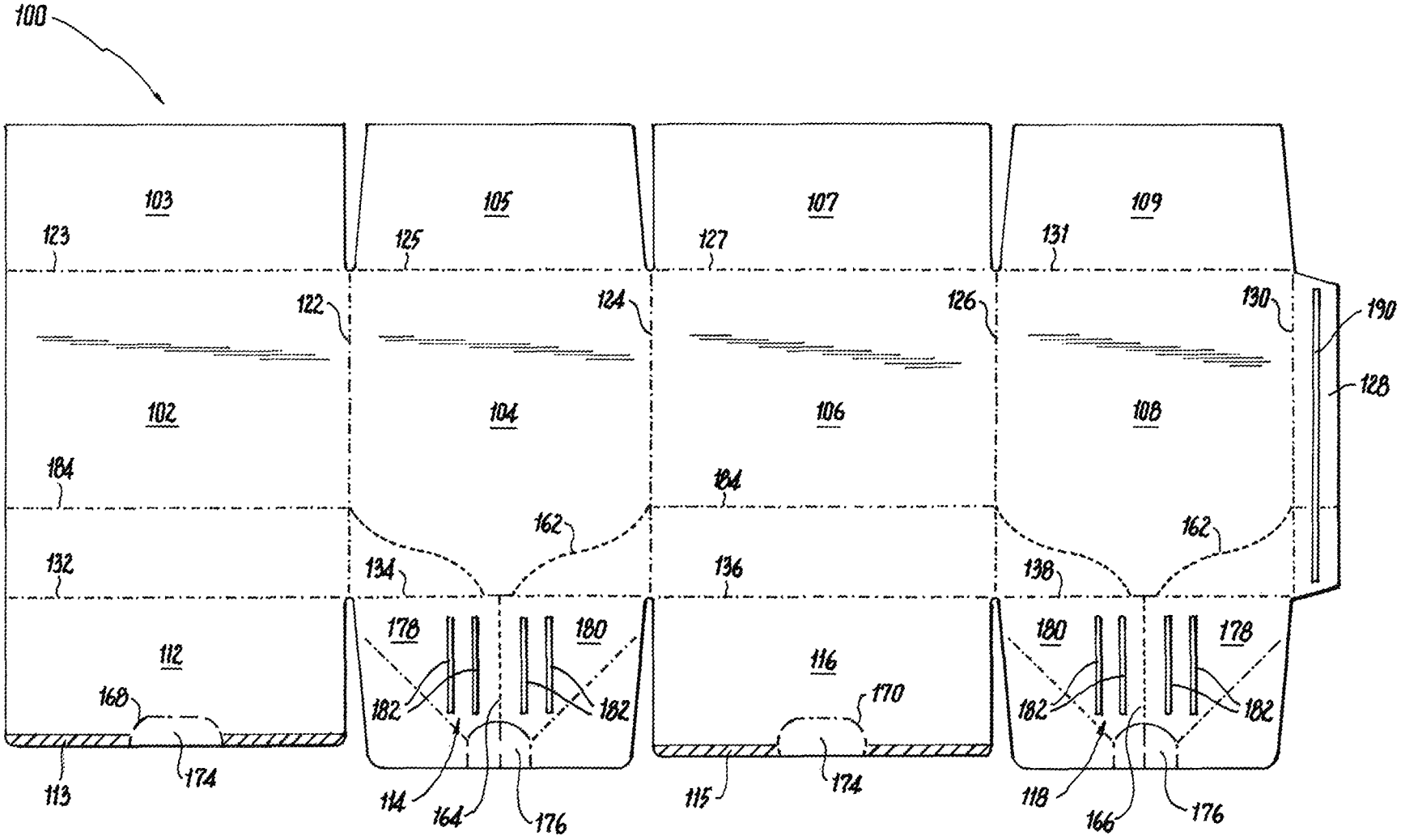
FIG. 1 is a plan view of an embodiment of a blank constructed in accordance with the present disclosure, showing the panels, flaps, and line of weakness pattern.

Reference will now be made to the drawings wherein like reference numerals identify similar structural features or aspects of the subject disclosure. For purposes of explanation and illustration, and not limitation, a partial view of an embodiment of a blank for a container in accordance with the disclosure is shown in FIG. 1 and is designated generally by reference character 100. Other embodiments of systems in accordance with the disclosure, or aspects thereof, are provided in FIGS. 2-6, as will be described. The systems and methods described herein can be used to provide custom sized shippers for products, e.g., for use in automated ecommerce packaging and shipping, which can provide an opening or unboxing experience for the end user.

Figure 2:
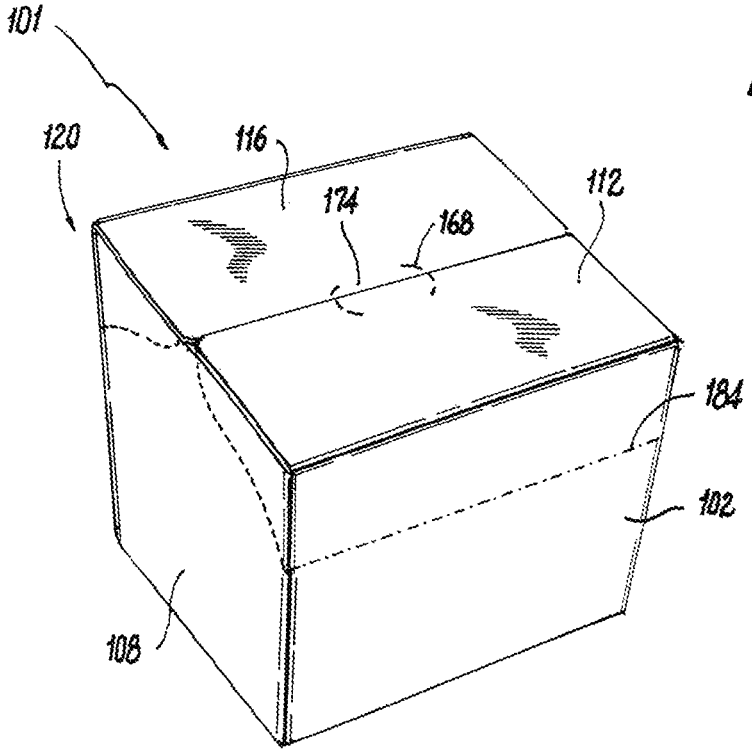
FIG. 2 is a perspective view of a container constructed from the blank of FIG. 1, showing a first stage in opening the container.
Figure 3:
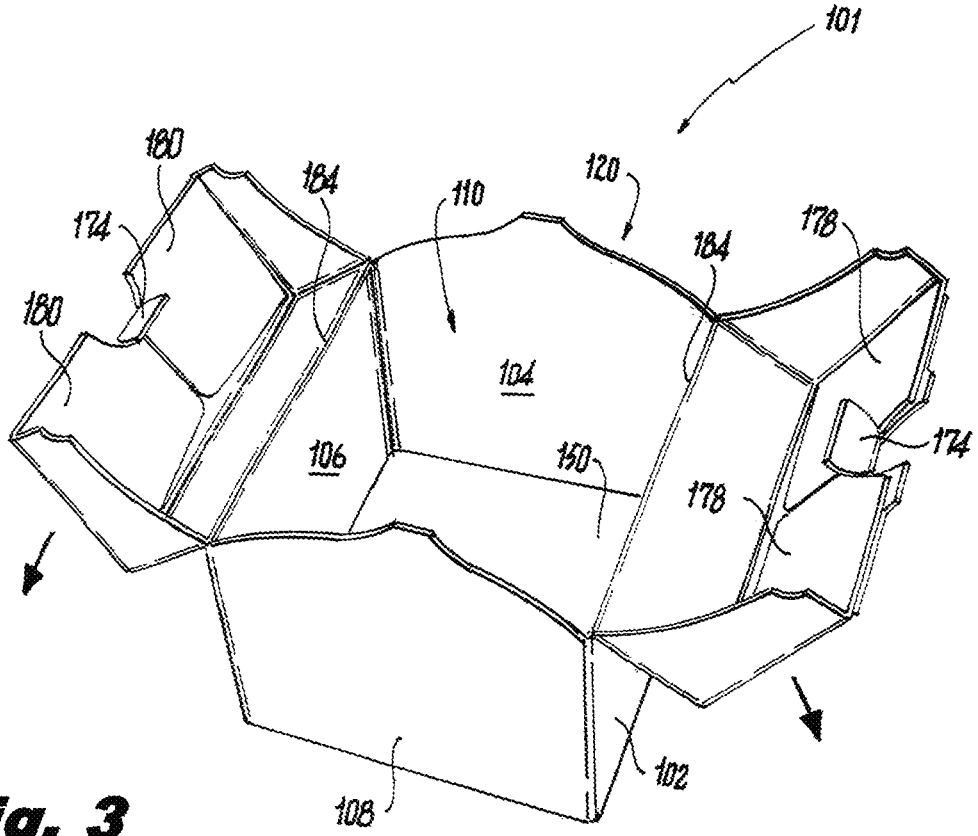
FIG. 3 is a perspective view of the container of FIG. 2, showing a second stage of opening the container.
Figure 4:
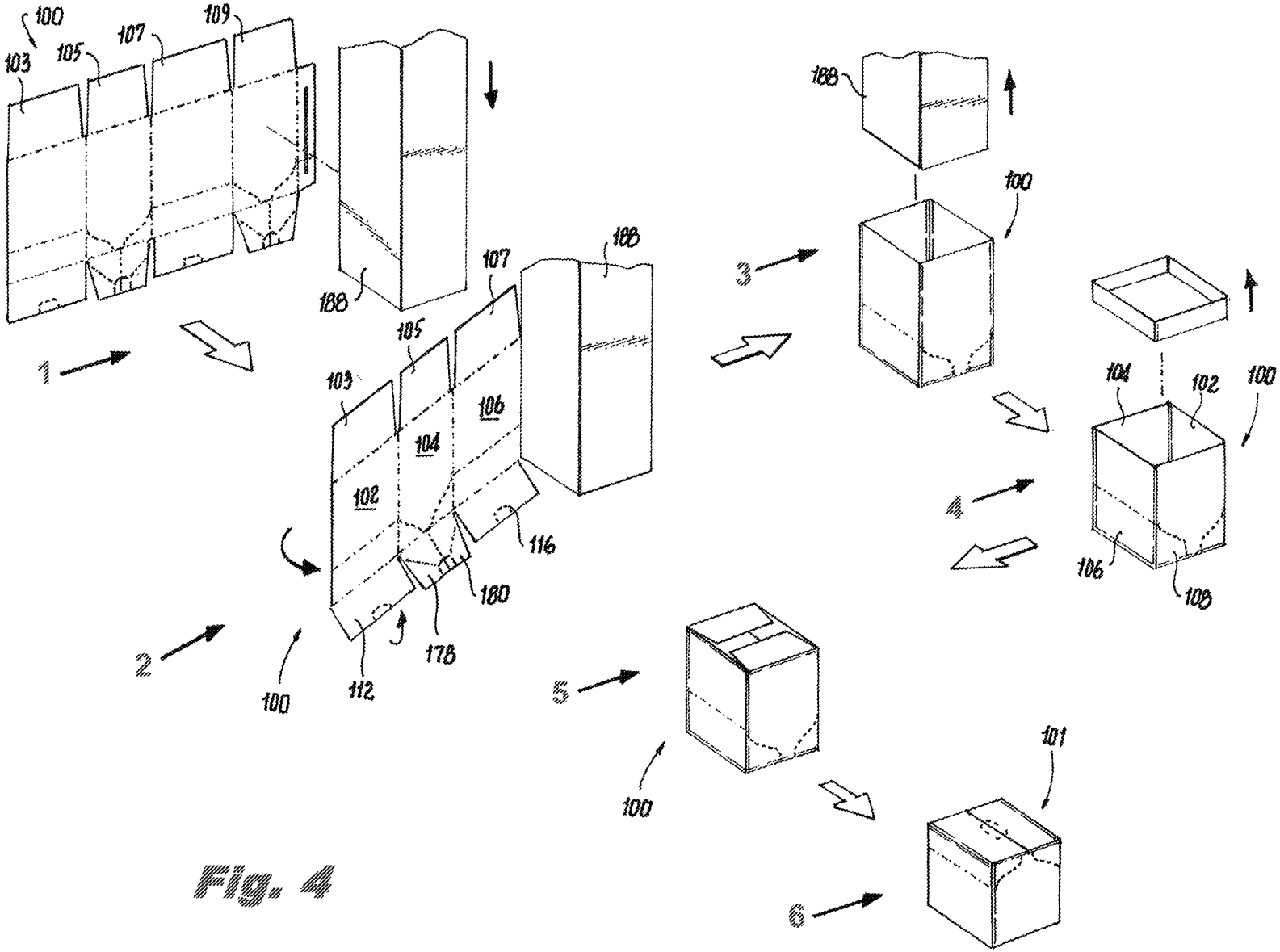
FIG. 4 is a schematic view of a method of making the container of FIG. 4.

The blank 100 includes a plurality of panels 102, 104, 106, 108 foldably connected to one another and erected about an interior space 110 (indicated in FIGS. 3-4). A plurality of top flaps 112, 114, 116, 118 are foldably connected to the plurality of panels 102, 104, 106, 108 to enclose a top end 120 (indicated in FIGS. 2-3) of the interior space 110. A plurality of bottom flaps 103, 105, 107, 109 are foldably connected to a corresponding panel 102, 104, 106, 108 to enclose the interior space 110 (indicated in FIG. 4). Each of the bottom flaps 103, 105, 107, 109 are separated from each other, and each is only attached to each corresponding panel 102, 104, 106, 108. The plurality of panels 102, 104, 106, 108 include a front panel 102 foldably connected to a first side panel 104 along a fold line 122, a back panel 106 opposed to the front panel 102 and foldably connected to the first side panel 104 along a fold line 124, and a second side panel 108 opposed to the first side panel 104 foldably connected to the back panel 106 along a fold line 126. An adhesive flap 128 is foldably connected to the second side panel 108 along a fold line 130 opposite the fold line 126.

The top flaps 112, 114, 116, 118 include a front top flap 112 foldably connected to the front panel 102 along a fold line 132, a back top flap 116 foldably connected to the back panel 106 along a fold line 136, a first side top flap 114 foldably connected to the first side panel 104 along a fold line 134, and a second side top flap 118 foldably connected to the second side panel 108 along a fold line 138 (where fold lines 132, 134, 136, 138 are optionally collinear).

With reference again to FIG. 1, the blank 100 includes a line of weakness pattern. The top flaps 112, 114, 116, 118, the first side panel 104, and the second side panel 108 include perforations 160, 162, 164, 166, 168, 170 of the line of weakness pattern. The perforations 160, 162 in the first and second side panels 104, 108 follow respective arcuate paths. The perforations 168, 170 in the top flaps 112, 116 define a top opener feature 174 configured for a user to initiate breaking the top flaps 112, 114, 116, 118.

With reference again to FIG. 1, the top flaps 112, 116 include corresponding crushed regions 113, 115. The crushed regions 113, 115 have a smaller thickness than the rest of the top flaps 112, 116. This allows the top portion 120 of container 101 to have a smoother closure when folded and closed.

The line of weakness pattern includes respective perforations 164, 166 across each respective one of the first and second side top flaps 114, 118. The perforations 164, 166 across each respective one of the first and second side top flaps 114, 118 can each connect to an edge notch 176 in the respective one of the first and second side top flaps 114, 118. The top opener feature 174 is aligned with the edge notches 176 when the container 101 is formed, as shown in FIG. 2. The perforations 164, 166 divide each of the first and second side top flaps 114, 118 into a front portion 178 and a back portion 180. It is also conceived that perforations 164, 166 can be fully or partially broken, or cut instead of being perforations. The front portions 178 are ultimately adhered to the front top flap 112, e.g., using adhesive lines 182, and the back portions 180 are adhered to the back top flap 116, e.g. using the adhesive lines 182, to form the container 101 shown in FIG. 2.

Each of the front and back panels 102, 106 includes a respective hinge line 184 defined therein for hinging the blank 100 into the open configuration shown in FIG. 3. Each hinge line 184 extends into each of the first and second side panels 104, 108 as oblique fold lines 186 which facilitate opening the container 101 into the open configuration shown in FIG. 3.

With reference now to FIG. 4, a method includes packaging a plurality of product items into respective containers 101. For each container 101, packaging includes (as indicated in stages 1 and 2 of FIG. 4) forming a blank 100 as described above around a mandrel 188 to surround the interior space 110 as shown in FIGS. 2-3. The adhesive flap 128 can be adhered to the front panel 102 using adhesive line 190 (labeled in FIG. 1). The top flaps 112, 116 can be adhered outside of the top flaps 114, 118 using the adhesive lines 182 (labeled in FIG. 1). Folding each of the bottom flaps 103, 105, 107, 109 across corresponding panel fold line 123, 125, 127,131 in order to enclose the container 101 from an end opposite the top end 120.

Product can be placed inside the interior space 110, e.g. after the mandrel 188 is removed in stage 3 of in FIG. 4, so that the product is packaged inside the interior space 110 at stage 6 of FIG. 4. For each respective container 101, the method can include cutting the plurality of panels 102, 104, 106, 108 (e.g. at stage 3 of FIG. 4) to a custom length to fit a custom shipment of product (e.g., as in a fulfillment center in ecommerce) before closing the container, wherein the custom length varies from container 101 to container 101.

With reference now to FIG. 2, and end user can open the container 101 by breaking the line of weakness pattern described above and hinging the top flaps 112, 114, 116, 118 into the open configuration shown in FIG. 3. The end user can break the opening feature 174 in the top flaps, gripping the opening feature 174 (e.g. by manually gripping the edge notches 176, labeled in FIG. 1, and pulling apart as indicated by the large outward facing arrows in FIG. 3) to break the top flaps 114, 118 along perforation lines 164 and 166. This allows hinging the top flaps 112, 114, 116, 118 and upper portions of the panels 102, 104, 106, 108 into the open configuration along the hinge lines 184 as shown in FIG. 4. The end user can then remove a product item or items from the interior space 110.

Figure 5:
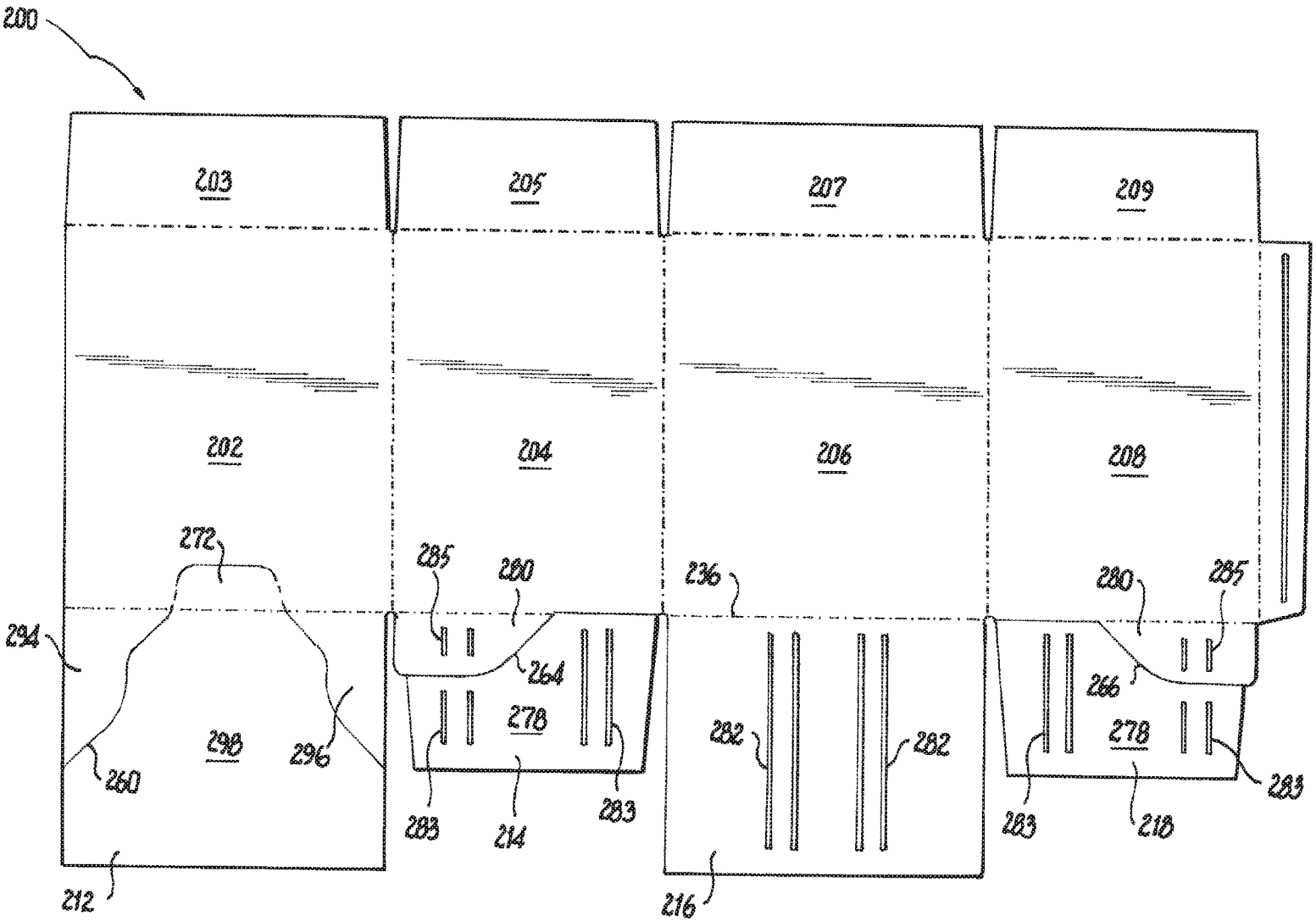
FIG. 5 is a plan view of another embodiment of the blank constructed in accordance with the present disclosure.

With reference now to FIG. 5, another embodiment of a blank 200 is shown with panels 202, 204, 206, 208 and top flaps 212, 214, 216, 218, and adhesive flap 228 foldably connected together much as described above with respect to FIG. 1. There is a line of weakness defined the top flaps 212, 214, 216, 218 and the front panel 202 that include perforations 260, 264, 266. The perforation 260 in the front panel 202 are configured for a user to initiate breaking the line of weakness pattern. The line of weakness pattern includes perforation 260 in the front top flap 212 and front panel 202, and respective perforations 264, 266 in the first side top flap 214 and the second side top flap 218. The perforation 264 in the first side top flap 214 divides the first side top flap 214 into a breakaway portion 278 adhered to the top back flap 216 with adhesive 282 (and adhered to a breakaway portion 298 of the front top flap 212 with adhesive 283) and a non-breakaway portion 280 adhered to a non-breakaway portion 294 of the front top flap 212 with adhesive 285. The perforation 266 in the second side top flap 218 divides the second side top flap 218 into a breakaway portion 278 adhered to the top back flap 216 with adhesive 282 (and adhered to the breakaway portion 298 the front top flap 212 with adhesive 283) and a non-breakaway portion 280 adhered to a non-breakaway portion 296 of the front top flap 212. The container 201 shown in FIG. 6 can be formed using a similar process to that described above with respect to FIG. 4.

Figure 6:
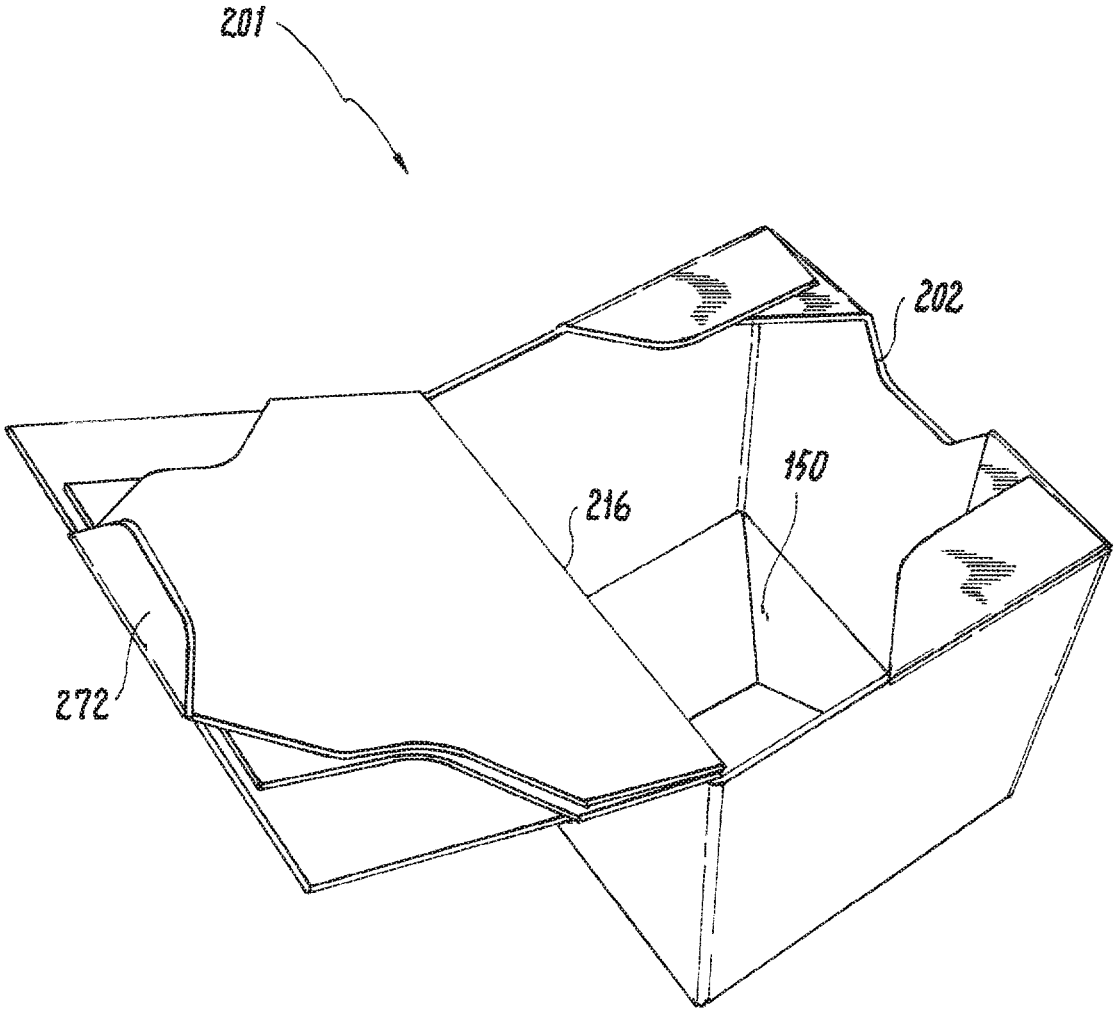
FIG. 6 is a perspective view of a container constructed from the blank of FIG. 5, showing the container after opening.

With continued reference to FIG. 6, the end user can open the container 201 by breaking the line of weakness pattern. This includes breaking the opening tab 272 in the front panel 202, breaking perforations 260, 264, 266 (labeled in FIG. 5), and hinging the back flap 216 along fold line 236 (connecting between the back panel 206 and the back top panel 216) into the open configuration.

Those skilled in the art will readily appreciate that the width and depth dimensions of the containers 101, 201 can readily be change as suitable for a given application. While described herein in the exemplary context of perforations, those skilled in the art will readily appreciate that any suitable type or combination of types of lines of weakness can be used such as but not limited to score lines, cut lines, partial depth cut lines, crush lines, and the like. It is contemplated that any suitable product type can be shipped in containers as disclosed herein, such as but not limited to clothing, essential oils, lightweight electronics, small parts, non-perishables, and the like. Additionally, systems and methods as disclosed herein allow the packer or ecommerce shipper to vary the height on a container by container basis based on the contents.

The methods and systems of the present disclosure, as described above and shown in the drawings, provide for custom sized shippers for products, e.g., for use in automated ecommerce packaging and shipping, which can provide an opening or unboxing experience for the end user. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising: a blank including a plurality of panels foldably connected to one another and erected about an interior space, and a plurality of top flaps foldably connected to the plurality of panels to enclose a top end of the interior space, and a plurality of bottom flaps wherein each of the bottom flaps is foldably connected to a corresponding panel of plurality of panels to enclose a bottom end of the interior space; and wherein the blank includes a line of weakness pattern configured to allow a user to break at least some of the top flaps so as to move said container from a closed configuration enclosing the interior space to an open configuration allowing access to the interior space;

wherein the plurality of panels include a front panel, a first side panel, a back panel opposed to the front panel, and a second side panel opposed to the first side panel;

wherein the top flaps, the first side panel, and the second side panel include perforations of the line of weakness pattern;

wherein the top flaps include a back top flap foldably connected to the back panel, a front top flap foldably connected to the front panel, a first side top flap foldably connected to the first side panel, and a second side top flap foldably connected to the second side panel, wherein the line of weakness pattern includes a respective line of weakness across each respective one of the first and second side top flaps that divides each respective one of the first and second side top flaps into a front portion and a back portion, wherein the front portions are adhered to the front top flap, and wherein the back portions are adhered to the back top flap;

wherein the perforations in the top flaps define a top opener feature in at least one of the front top flap and the back top flap, the top opener feature being configured for a user to initiate breaking the top flaps;

wherein each of the front and back panels includes a respective hinge line defined therein for hinging the container into the open configuration.

2. The container as recited in claim 1, wherein the bottom flaps include a gap between each adjacent bottom flap.

3. The container as recited in claim 1, wherein the perforations in the first and second side panels follow respective arcuate paths.

4. The container as recited in claim 1, wherein each hinge line extends into each of the first and second side panels.

5. The container as recited in claim 4, wherein each of the hinge lines are spaced apart below a respective fold line connecting between the respective top flaps and the front panel and the back panel.

6. The container as recited in claim 1, wherein each respective line of weakness across each respective one of the first and second side top flaps is a cut line.

7. The container as recited in claim 1, wherein each respective line of weakness across each respective one of the first and second side top flaps is a perforation.

8. A container comprising: a blank including a plurality of panels foldably connected to one another and erected about an interior space, and a plurality of top flaps foldably connected to the plurality of panels to enclose a top end of the interior space, and a plurality of bottom flaps wherein each of the bottom flaps is foldably connected to a corresponding panel of plurality of panels to enclose a bottom end of the interior space; and wherein the blank includes a line of weakness pattern configured to allow a user to break at least some of the top flaps from a closed configuration enclosing the interior space to an open configuration allowing access to the interior space;

wherein the plurality of panels include a front panel, a first side panel, a back panel opposed to the front panel, and a second side panel opposed to the first side panel;

wherein the top flaps, the first side panel, and the second side panel include perforations of the line of weakness pattern;

wherein the top flaps include a back top flap foldably connected to the back panel, a front top flap foldably connected to the front panel, a first side top flap foldably connected to the first side panel, and a second side top flap foldably connected to the second side panel, wherein the line of weakness pattern includes a respective line of weakness across each respective one of the first and second side top flaps;

wherein the perforations across each respective one of the first and second side top flaps each connect to an edge notch in the respective one of the first and second side top flaps.

9. The container as recited in claim 8, wherein a top opener feature is formed in at least one of the front top flap and the back top flap, said top opener feature being aligned with the edge notches of the first and second side top flaps, the top opener feature being configured for a user to initiate breaking the top flaps.

10. The container as recited in claim 8, wherein the perforations across each respective one of the first and second side top flaps divide each of the first and second side top flaps into a front portion and a back portion, wherein the front portions are adhered to the front top flap, and wherein the back portions are adhered to the back top flap.

11. A container comprising: a blank including a plurality of panels foldably connected to one another and erected about an interior space, and a plurality of top flaps foldably connected to the plurality of panels to enclose a top end of the interior space, and a plurality of bottom flaps wherein each of the bottom flaps is foldably connected to a corresponding panel of plurality of panels to enclose a bottom end of the interior space; and wherein the blank includes a line of weakness pattern configured to allow a user to break at least some of the top flaps from a closed configuration enclosing the interior space to an open configuration allowing access to the interior space;

wherein the plurality of panels include a front panel, a first side panel, a back panel opposed to the front panel, and a second side panel opposed to the first side panel;

wherein the top flaps and the front panel include perforations of the line of weakness pattern;

wherein the top flaps include a back top flap foldably connected to the back panel, a front top flap foldably connected to the front panel, a first side top flap foldably connected to the first side panel, and a second side top flap foldably connected to the second side panel, wherein the line of weakness pattern includes perforations in the front top flap, the first side top flap, and the second side top flap;

wherein the perforation in the first side top flap divides the first side top flap into a breakaway portion adhered to the top back flap and a non-breakaway portion adhered to a non-breakaway portion of the front top flap, wherein the perforation in the second side top flap divides the second side top flap into a breakaway portion adhered to the top back flap and a non-breakaway portion adhered to a non-breakaway portion of the front top flap, and wherein a breakaway portion of the front top flap is adhered to the breakaway portions of the first and second side top flaps.

12. A blank for forming a container, the blank comprising: a plurality of panels foldably connected to one another configured to be erected about an interior space, and a plurality of top flaps foldably connected to the plurality of panels configured to enclose a top end of the interior space, and a plurality of bottom flaps wherein each of the bottom flaps is foldably connected to a corresponding panel of plurality of panels to enclose a bottom end of the interior space, wherein the blank includes a line of weakness pattern configured to allow breaking the top of a set-up container to move the set-up container from a closed configuration to an open configuration;

wherein the plurality of panels include a front panel, a first side panel, a back panel configured to be opposed to the front panel in the set-up container, and a second side panel configured to be opposed to the first side panel in the set-up container;

wherein the top flaps, the first side panel, and the second side panel include perforations of the line of weakness pattern;

wherein the top flaps include a back top flap foldably connected to the back panel, a front top flap foldably connected to the front panel, a first side top flap foldably connected to the first side panel, and a second side top flap foldably connected to the second side panel, wherein the line of weakness pattern includes a respective line of weakness across each respective one of the first and second side top flaps that divides each respective one of the first and second side top flaps into a front portion and a back portion, wherein the front portions are configured to be adhered to the front top flap in the set-up container, and wherein the back portions are configured to be adhered to the back top flap in the set-up container;

wherein the perforations in the top flaps define a top opener feature in at least one of the front top flap and the back top flap, the top opener feature being configured in the set-up container for a user to initiate breaking the top flaps;

wherein each of the front and back panels includes a respective hinge line defined therein for hinging the set-up container into the open configuration.

* * * * *